US005839625A

United States Patent [19]

Braginetz

[11] Patent Number: 5,839,625

[45] Date of Patent: Nov. 24, 1998

[54] EXTRUDED FLUTED INSERT DISPENSING TUBE

[75] Inventor: Paul A. Braginetz, Staunton, Va.

[73] Assignees: David L. Pullin, Staunton, Va.; James G. O'Boyle, Washington, D.C.

[21] Appl. No.: 896,169

[22] Filed: Jul. 17, 1997

[51] Int. Cl.[6] ..... B67D 5/60; B67D 3/00; B65B 1/04

[52] U.S. Cl. ..... 222/464.1; 222/464.2; 222/478; 222/479; 141/285

[58] Field of Search ..... 222/464.1, 478, 222/479, 464.2; 141/285

[56] References Cited

U.S. PATENT DOCUMENTS

| | | | |
|---|---|---|---|
| 1,676,711 | 7/1928 | Reap | 222/479 |
| 2,992,761 | 7/1961 | Sommers, Sr. | 222/479 |
| 3,107,031 | 10/1963 | Adams | 222/464.1 |
| 3,506,167 | 4/1970 | Orr | 222/479 |
| 3,901,417 | 8/1975 | Schiemann | 222/479 |
| 4,398,652 | 8/1983 | Ueda et al. | 222/479 |
| 4,597,513 | 7/1986 | Schiemann | 222/476 |
| 4,838,464 | 6/1989 | Briggs | 222/478 |
| 5,199,613 | 4/1993 | Magrath et al. | 222/478 |
| 5,305,810 | 4/1994 | Meshberg | 222/211 |

*Primary Examiner*—Andres Kashnikow
*Assistant Examiner*—Keats Quinalty

[57] ABSTRACT

An extruded, fluted, plastic tube is inserted through the neck of a container containing liquid. The free end of the tube is spaced from the bottom wall of the container, while the opposite end is frictionally held in the container neck portion. The side wall of the tube is provided with at least one flute formed by a longitudinal recess extending either the entire length of the tube or a portion of the length of the tube. During the filling of the container, the tube functions as a fill tube, and the flute functions as an air vent. During the pouring of the liquid from the container, the tube functions as a dispensing tube, and the flute functions as a dispensing port to thereby provide a continuous, rather than a turbulent, flow of liquid from the container.

7 Claims, 3 Drawing Sheets

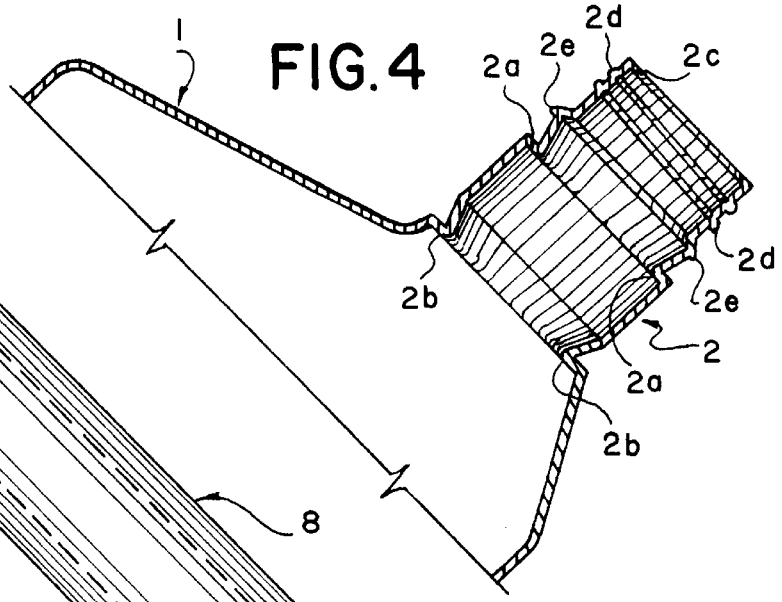
FIG. 4
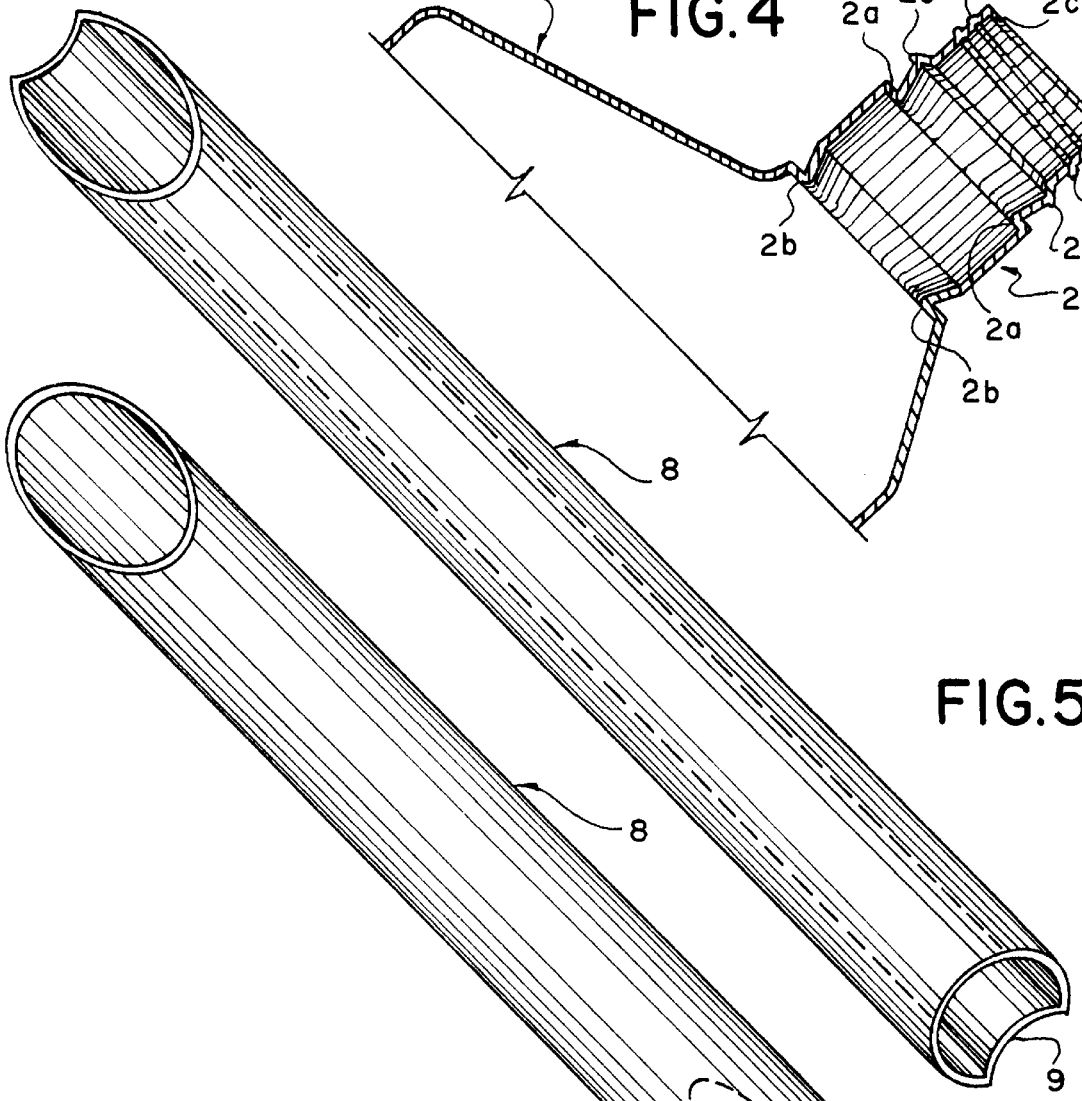
FIG. 5
FIG. 6

EXTRUDED FLUTED INSERT DISPENSING TUBE

BACKGROUND OF THE INVENTION

When pouring liquid from a container having a narrow neck portion, air bubbles enter the container through the neck portion and flow through the remaining portion of the liquid in the container resulting in a sporadic or turbulent flow of the liquid through the container neck resulting in an overspill of the dispensed liquid.

This is particularly true when using plastic bottles having the configuration shown in Design U.S. Pat. Nos. 289,376 and 352,904 wherein the neck of the bottle is offset from the longitudinal axis of the bottle. These bottles are adapted to contain motor oil, and to reduce or eliminate the turbulent or sporadic flow of oil through the bottle neck. The manufacturer recommends that the bottle be held in such a manner that the bottle neck is positioned quite a distance from the engine oil intake hole. Most users want to position the bottle neck as close as possible to the engine oil intake; therefore, the bottle is held in a position opposite to the recommended position resulting in the turbulent flow of the oil through the neck and the overspill of oil at the engine oil intake hole.

To overcome the turbulent flow of liquid through the neck portion of a container, the dispensing tube of the present invention has been devised to provide a continuous or laminar flow of liquid through the container neck portion.

SUMMARY OF THE INVENTION

The dispensing tube of the present invention comprises, essentially, an extruded fluted, plastic tube adapted to be inserted through the neck of a container containing liquid. The free end of the tube is spaced from the bottom wall of the container, while the opposite end is frictionally held in the container neck. The side wall of the tube is provided with at least one flute, formed by a longitudinal recess extending either the entire length of the tube or a portion of the length of the tube.

By this construction and arrangement, during the filling of the container, the tube functions as a fill tube, and the flute functions as an air vent. During the pouring of the liquid from the container, the tube will initially function as a dispensing tube, and the flute will function as a dispensing port. When the liquid level in the container reaches a position below the free end of the tube, the liquid continues to flow through the flute, to thereby provide a continuous, rather than turbulent, flow of liquid from the container.

BRIEF DESCRIPTION OF THE DRAWINGS

FIG. 4 is an enlarged, fragmentary, sectional view illustrating the threaded neck portion employed with the containers of the present invention;

FIG. 5 is a perspective view of one embodiment of the fluted, dispensing tube of the present invention wherein the flute extends the entire lengths of the tube;

FIG. 6 is a perspective view of another embodiment of the fluted dispensing tube of the present invention wherein the flute extends a portion of the length of the tube;

DESCRIPTION OF THE PREFERRED EMBODIMENTS

Figure 1:
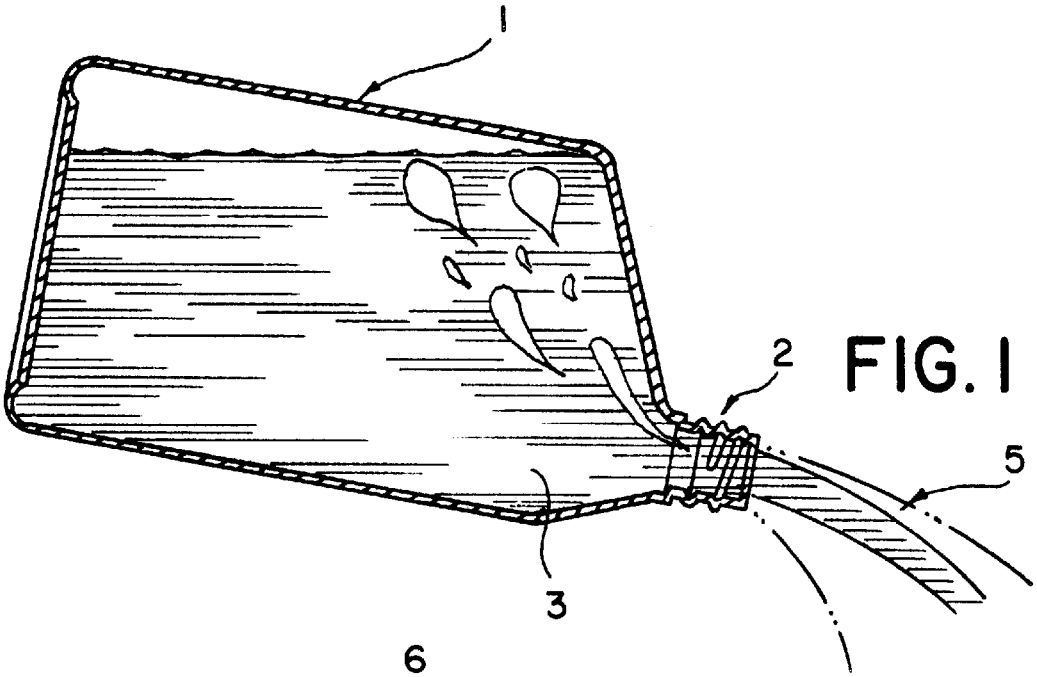
FIG. 1 is a perspective side elevational view of a container having its neck portion offset from the longitudinal axis of the container and showing the container in a pouring position causing sporadic or turbulent flow of liquid through the container neck.
Figure 3:
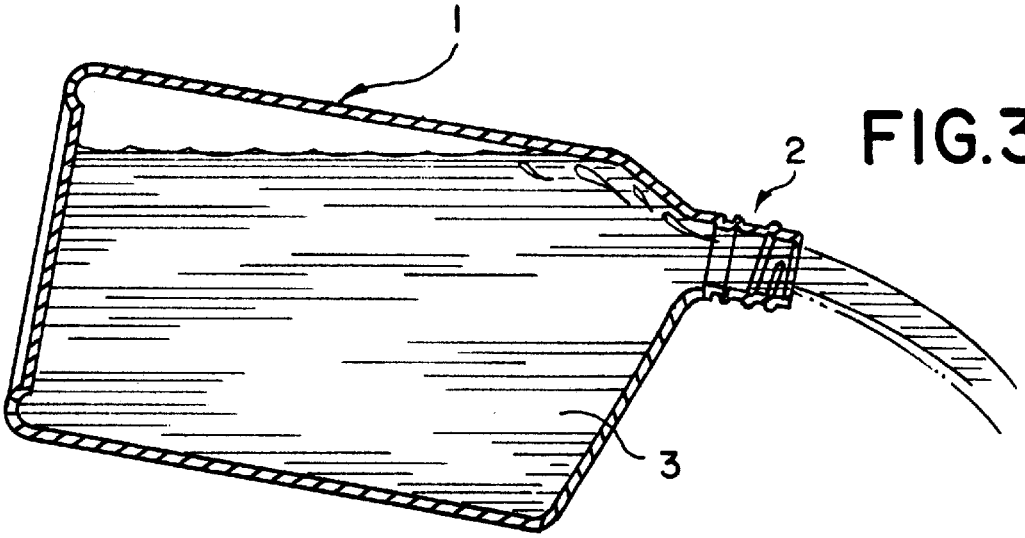
FIG. 3 is a sectional, side elevational view of the container shown in FIG. 1, but in a pouring position to provide a continuous flow of liquid from the container.

Referring to the drawings and, more particularly to FIGS. 1 and 3, there are shown containers 1 having a threaded neck portion 2 offset from the longitudinal axis of the container. These containers are conventional plastic bottles having the configuration shown in Design U.S. Pat. Nos. 289,376 and 352,904. These containers are plastic bottles adapted to contain motor oil 3, and to reduce or eliminate the turbulent or sporadic flow 5 of oil through the bottle neck as shown in FIG. 1. The manufacturer recommends that the bottle 1 be held in the position shown in FIG. 3 resulting in the threaded neck portion 2 being positioned quite a distance from an engine oil intake hole (not shown). Most users want to position the bottle neck as close as possible to the engine oil intake; therefore, the bottle is held in a position shown in FIG. 1 resulting in the turbulent flow 5 of oil through the neck 2, and the concomitant overspill of oil at the engine and intake hole.

Figure 2:
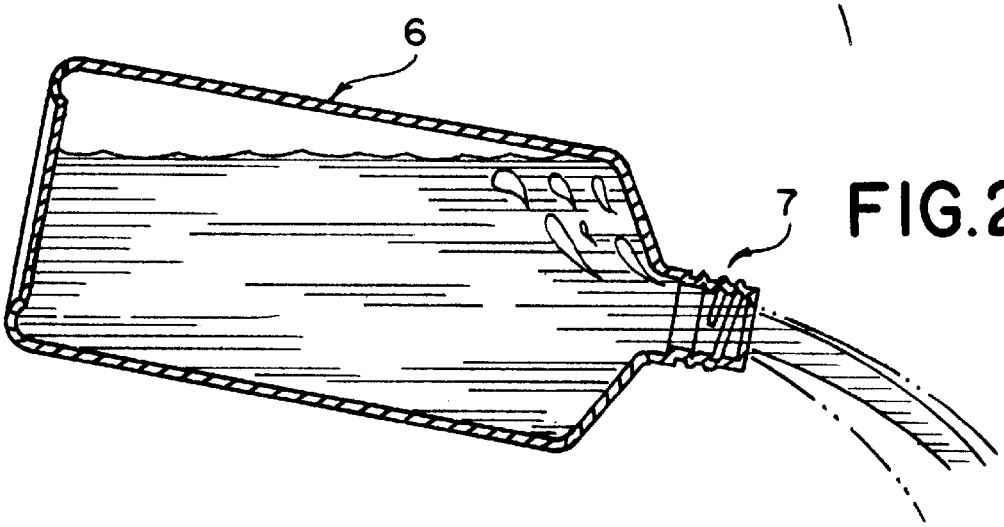
FIG. 2 is a sectional side elevational view of a container having its neck portion aligned with the longitudinal axis of the container, and illustrating the sporadic or turbulent flow of liquid through the container neck.

The same problem exists in conventional containers 6 shown in FIG. 2 wherein the threaded neck portion 7 is aligned with the longitudinal axis of the container.

To overcome the turbulent flow 5 of liquid through the neck portion 2 of the container 1, the dispensing tube 8 of the present invention has been devised, as shown in FIGS. 5 and 6. The tube 8 is an extruded plastic tube having at least one flute formed by a recess 9 in a side wall of the tube 8 and extending the entire length of the tube, as shown in FIG. 5, or a portion of the tube length as shown in FIG. 6.

The tube 8 is adapted to be inserted into the neck 2 of the container 1 and held therein by a friction fit. To this end, the neck 2, as seen in FIG. 4, is provided with a pair of axially spaced, inwardly extending annular shoulders 2*a* and 2*b*, and the open end edge of the neck 2 is provided with an inwardly extending annular flange portion or lip 2*c*. The neck 2 is also provided with threads 2*d* for the closure cap, not shown, and an outwardly extending annular shoulder 2*e* adapted to be engaged by a conventional tamper-evident ring, not shown.

Figure 7:
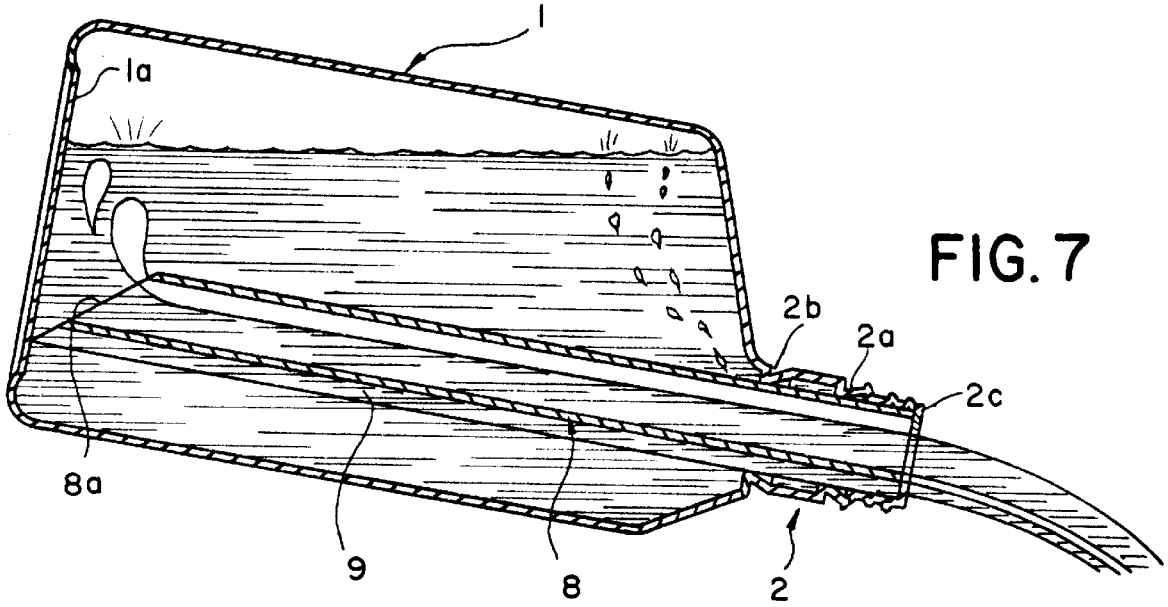
FIG. 7 is a sectional side elevational view of the container shown in FIG. 1, having the fluted tube shown in FIG. 5 mounted therein, and illustrating the flow of liquid through the tube and flute.
Figure 8:
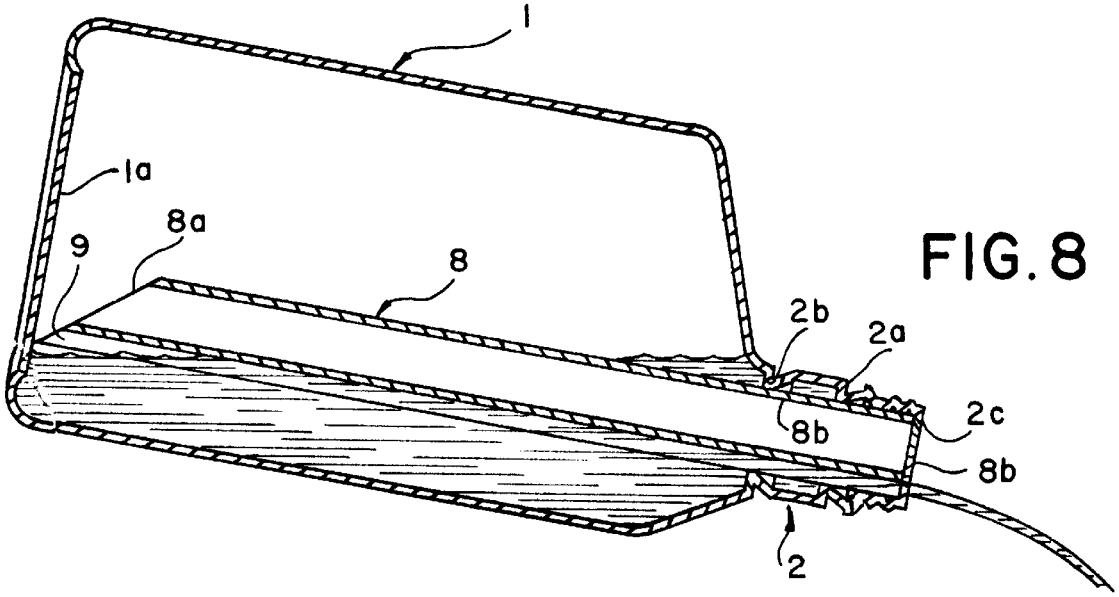
FIG. 8 is a sectional side elevational view of the container and tube, as shown in FIG. 7, illustrating the liquid level in the container being below the tube, and the flow of liquid through the flute.

FIGS. 7 and 8 show the tube 8 mounted in the container 1 wherein the free end 8*a* of the tube 8 is spaced from the bottom wall 1*a* of the container while the opposite end portion 8*b* of the tube is frictionally held in the neck 2 by the inwardly extending shoulders 2*a* and 2*b* engaging the outer surface of the tube. The tube 8 is inserted into the container 1 until the opposite end 8*b* snaps underneath the lip 2*c* on the neck 2.

With the tube 8 mounted in the container 1 as shown in FIGS. 7 and 8, during the filling thereof, the tube 8 functions as a fill tube, and the flute 9 functions as an air vent. During the pouring of the liquid from the container 1, the tube 8 will initially function as a dispensing tube as shown in FIG. 7, and the flute 9 will function as a dispensing port, whereby a continuous flow of liquid is dispensed from the container. When the liquid level in the container 1 reaches a position below the free end 8*a* of the tube 8, as shown in FIG. 8, the liquid continues to flow in a continuous manner through the flute 9.

When the extruded, fluted, dispensing tube 8 of the present invention is inserted into a plastic bottle, containing motor oil and having a configuration disclosed in the above-mentioned design patent, the user will be able to position the neck 2 of the bottle in proximity to the engine oil intake hole, and the fluted dispensing tube 8 will provide a continuous flow of oil from the bottle, to thereby prevent overspill of oil at the engine oil intake hole.

While the dispensing tube 8 of the present invention has been shown and described for use in a container having an offset neck portion, it can also be employed in the container 6 as shown in FIG. 2 wherein the neck 7 is aligned with the longitudinal axis of the container 6.

Also, the tube 8 can be inserted in the containers 1 and 6 at the place of manufacture and/or filling of the container, or it can be sold as an after-market item and inserted into a tubeless container by the user.

It is to be understood that the form of the invention herewith shown and described is to be taken as a preferred example of the same, and that various changes in the shape, size, and arrangement of parts may be resorted to, without departing from, the spirit of the invention or scope of the subjoined claims.

We claim:

1. In combination, a fluted dispensing tube and a container having a bottom wall and a neck portion, said fluted dispensing tube comprising a tube having a longitudinally extending recess formed on an exterior surface of a side wall of the tube, said recess extending to at least a first end portion of said tube to thereby form a fluted tube, said tube being inserted through said neck portion into said container, a second end portion of the tube being spaced in close proximity to the bottom wall of the container, at least one inwardly extending shoulder integral with a side wall of the container neck portion engaging the exterior surface of the fluted tube at the first end portion thereof, to thereby frictionally hold the fluted tube wholly contained in said container, said flute providing a vent and a pouring port for the container, whereby when pouring liquid out of the container, the liquid flows initially through the tube and flute, until the level of liquid goes below the second end portion of the tube when the liquid flows only through the flute, to thereby provide a continuous, rather than a turbulent, flow of liquid from the container.

2. The combination according to claim 1 wherein the neck portion is offset from the longitudinal axis of the container.

3. The combination according to claim 1, wherein a pair of longitudinally spaced shoulders are provided on the side wall of said neck portion.

4. The combination according to claim 1, wherein an inwardly extending annular flange portion is provided on an open end edge of the neck portion, said first end portion of said tube being snapped underneath said annular flange.

5. The combination according to claim 1, wherein the recess extends from the first end portion of the tube to the second end portion.

6. The combination according to claim 1, wherein the recess extends from the first end portion of the tube to a portion of the length of the tube.

7. The combination according to claim 1, wherein the tube is an extruded plastic tube.

* * * * *